United States Patent [19]

Taylor

[11] 4,210,037

[45] Jul. 1, 1980

[54] SPANNER WRENCH

[76] Inventor: Alfred Taylor, 508 Budd St., Elmira, N.Y. 14904

[21] Appl. No.: 937,551

[22] Filed: Aug. 28, 1978

[51] Int. Cl.[2] ..... B25B 13/48

[52] U.S. Cl. ..... 81/90 C

[58] Field of Search ..... 81/90 C, 90 R

[56] References Cited

U.S. PATENT DOCUMENTS

| | | | |
|---|---|---|---|
| 1,882,462 | 10/1932 | Weber | 81/90 C |
| 2,803,981 | 8/1957 | Stoecker | 81/90 C |
| 3,731,560 | 5/1973 | Bares | 81/90 C |

*Primary Examiner*—James G. Smith

*Attorney, Agent, or Firm*—George E. Clark

[57] ABSTRACT

A Spanner Wrench includes a handle, a support bar connected to the handle, the bar having holes drilled through it at the respective ends of the bar, and an eccentrically mounted drive pin carrier, the drive pin carrier including a base plate, having a rod mounted on one face thereof near the edge of the plate and having a drive pin mounted on a second face thereof at a position diametrically opposite to the mounting rod position. The mounting rod having a portion opposite to the end mounted on the base plate threaded to accept a nut which when tightened holds the base plate firmly against the bar. The range of adjustment of a Spanner Wrench according to the present invention is approximately four times the length or diameter of the base plate.

4 Claims, 6 Drawing Figures

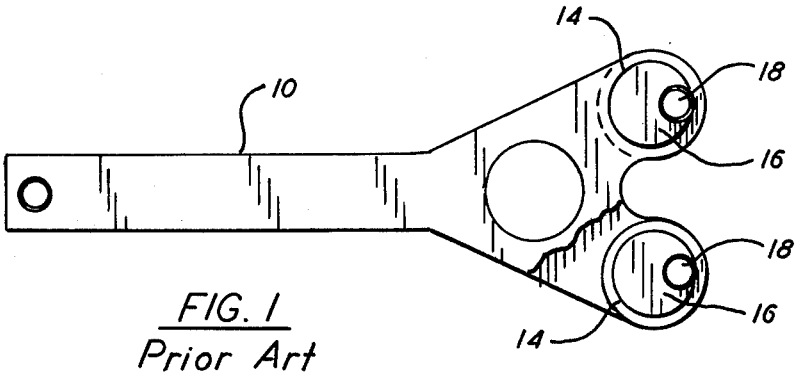
FIG. 1
Prior Art
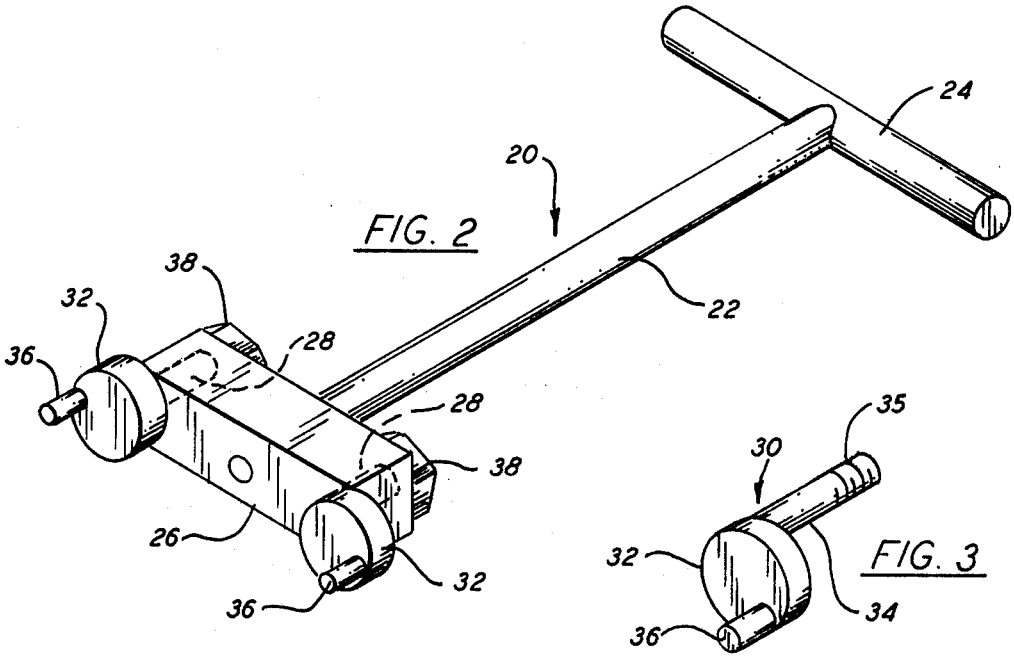
FIG. 2
FIG. 3
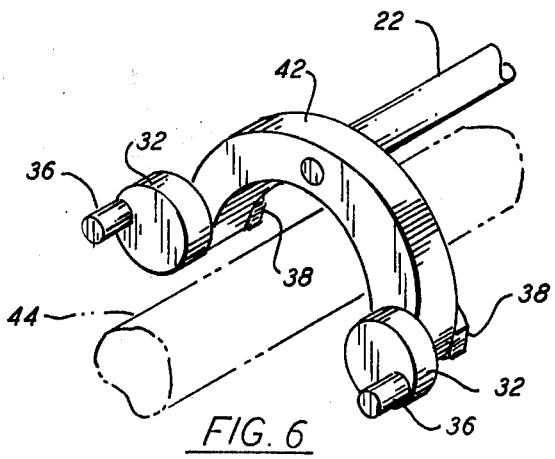
FIG. 6
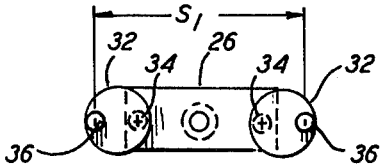
FIG. 4
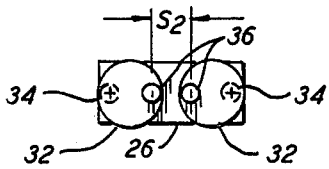
FIG. 5

SPANNER WRENCH

BACKGROUND OF THE INVENTION

The present invention relates to Spanner Wrenches and more particularly to spanner wrenches in which the span between the drive pins is adjustable.

In the prior art, there are many and various spanner wrenches.

Specifically, there are several adjustable spanner wrenches which provide an adjustable span between slots in an article to be turned.

U.S. Pat. No. 2,803,981, shows a spanner wrench in which a pivotally mounted bar at the base of the wrench has a slot wherein drive pins are mounted. The span between the drive pins is adjusted by moving the drive pins within the slots and the drive pins are tightened at a desired position by nuts mounted on a threaded upper portion of the drive pin. The spanner wrench according to the patent has the disadvantage that as the tightening nuts become loosened, the drive pins slide along the slots and it is difficult to maintain the proper spacing. Also, with wear, the drive pins would tend to slide in the slots, thus limiting the usefulness of the wrench. Further, the range of adjustment is limited to twice the length of the slot.

Another adjustable spanner wrench is shown in U.S. Pat. No. 3,010,347, in which the L-shaped members are attached to the movable and fixed jaws of a cresent wrench. Adjustment of spacing is made by opening or closing the jaws of the Cresent Wrench. While this patent shows a device which has a certain amount of flexibility, the handle of the Cresent Wrench must be relatively at right angle to the axis about which the article is to be turned. In many applications where space is limited such a wrench would not be useable.

Another adjustable spanner wrench in the prior art is shown in U.S. Pat. No. 3,731,560, which shows a wrench having a Y-shaped handle wherein each of the branches of the Y has a hole therein to accept a disk which is rotatbly mounted in the hole and wherein the disk has a drive pin mounted near the edge of one face thereof. An adjustable spanner wrench according to this patent is limited to a range of adjustment which is equal to twice the diameter of the disks mounted in the holes in the Y-shaped handle. Also, as above, the handle must be at right angle to the article which is to be turned.

SUMMARY OF THE INVENTION

Therefore, it is the object of the present invention to provide an adjustable spanner wrench having a range of adjustment which is approximately twice as great as prior art adjustable spanner wrenches.

It is another object of the present invention to provide a spanner wrench with a wide range of adjustment in which the torquing handle of the spanner wrench is along the axis of the article to be turned.

It is a further object of the present invention to provide a spanner wrench having a wide range of adjustment in which it is adapted to turn an article mounted on or near a circular shaft.

Accordingly, an adjustable spanner wrench according to the present invention includes a handle portion having a support bar fixed on an end thereof. The handle lies along the axis of the article to be turned. The support bar has first and second holes near respective ends of said support bar, and first and second drive pin mounting means mounted in said first and second holes in said support bar. The drive pin mounting means has a base plate which may be circular or of any configuration having first and second faces, a mounting bolt attached to a first face of said base plate near one end or edge thereof, said mounting bolt being mounted in one of said holes in said support bar, and being attached to said bar by a fastener such as a nut. The base plate having a drive pin mounted on an opposite face from the face on which the mounting bolt is mounted. The drive pin is mounted on an opposite end or diametrically opposite from the position of the mounting bolt such that the mounting bolt and drive pin are offset from each other by approximately a length or diameter of the base plate. The support bar may be of a semi-circular configuration to allow the wrench to be used around a shaft. The configuration of the adjustable spanner wrench according to the present invention permits an adjustment of approximately four times the length or diameter of the base plate.

Other objects, features, and advantages of the present invention will become apparent from the following description of preferred embodiments of the invention considered in conjunction with the drawing.

BRIEF DESCRIPTION OF THE DRAWING

FIG. 1 is a plan view of an adjustable spanner wrench according to the prior art.

FIG. 2 is an isometric view of a first embodiment of a spanner wrench according to the present invention.

FIG. 3 is an isometric view of a drive pin carrier for use with spanner wrenches according to the present invention.

FIG. 4 is an end view showing a spanner wrench with the widest opening or span.

FIG. 5 is an end view of a spanner wrench according to the present invention showing the adjustment for the smallest or narrowest opening or span.

FIG. 6 is a perspective view of a second embodiment of a spanner wrench according to the present invention.

DETAILED DESCRIPTION OF THE INVENTION

Referring now to FIG. 1, the prior art adjustable spanner wrench as shown by U.S. Pat. No. 3,731,560, will be discussed with reference to the present invention as shown in FIGS. 2, 3, and 6.

The prior art Y-shaped spanner wrench has a handle 10 at right angle to drive pins 18. Drive pins 18 are mounted near an edge of disks 16 which are rotatably mounted in slots for holes 14. It can be seen that the greatest adjustment of the wrench is equal to twice the diameter of disk 16. That is, if the pins 18 are nearest each other at the smallest span and then both pins 18 are moved opposite each other at the greatest span the difference in distance or span is approximately equal to twice the diameter of disk 16.

The present invention as shown in a first embodiment in FIG. 2 and FIG. 3 has a range of adjustment which can be at least twice as great as the prior art spanner wrench shown in FIG. 1.

Spanner Wrench 20 according to a first embodiment of the present invention includes a handle 22 having a cross member 24 at one end thereof to allow an operator to grasp the handle and apply a turning force and at the other end thereof a support bar 26 is fixed thereto. Cross member 24 and support bar 26 may be welded to handle 22 or mounted in any suitable fashion to avoid relative rotation of the bars.

Drive pin carrier 30 as shown in FIG. 3 includes a base plate 32 which although shown as a circular disk might be any shape including eliptical or rectangular. A mounting bolt 34 is mounted on one face of base plate 32 near the edge of base plate 32. On the opposite face of base plate 32 drive pin 36 is mounted at the opposite end or diametrically opposed from the point at which mounting bolt 34 is affixed to base plate 32. Mounting bolt 34 has a threaded portion 35 on the free end thereof upon which is mounted adjustment tightening nut 38. Mounting bolt 34 passes through hole 28 cut through bar 26.

Referring now to FIGS. 4 and 5 as well as FIGS. 2 and 3, it will be seen that if the widest possible span of the wrench is desired, drive pins 36 are rotated to the point at which they are opposite each other and outside the edge of bar 26. In this configuration, the wrench has its greatest span. Adjustment tightening nuts may then be tightened to secure the drive pins 36 in the proper position.

If the smallest possible span is desired, base plates 32 are each rotated 180° until drive pins 36 are nearest each other and near the center of bar 26. Again adjustment nuts 38 may be tightened holding the drive pins 36 in the desired position. FIGS. 4 and 5 show that the total range of adjustment from widest span to narrowest span of a spanner wrench according to the present invention is approximately four times the diameter of base plate 32 or if a rectangular base plate were used it would be approximately four times the length of base plate 32.

Referring again to FIG. 3, drive pin carrier 30 may be machined from a single piece of bar stock to improve ridgity and strength and to reduce costs.

It can be seen that a spanner wrench constructed according to the present invention has an adjustment range which is approximately twice as great as the prior art discussed above with reference to FIG. 1.

Referring now to FIG. 6, a second embodiment of a spanner wrench according to the present invention is shown in which support bar 42 is formed in a semi-circular configuration to allow the spanner wrench to be used around shaft 44. Support bar 42 is connected to handle 22 as a replacement for bar 26 shown in the embodiment described with reference to FIG. 2. As before, adjustment mechanism 30 is mounted in holes through semi-circular bar 42 and near the ends thereof. Adjustment tightening nuts 38 tighten the drive pin carrier 39 in the desired position.

A spanner wrench according to the present invention is inexpensive, versatile and has a range of adjustment approximately twice that which is shown in the prior art.

Although the present invention has been described with reference to preferred embodiments thereof, it will be understood by those skilled in the art that various changes in detail may be made without departing from the spirit or scope of the invention.

What is claimed is:

1. A spanner wrench, comprising:

a handle having attached thereto at one end thereof a support bar; said support bar having first and second holes therein near respective ends of said support bar; and an adjustable drive pin carrier having a base plate and a mounting bolt on one face of said base plate said mounting bolt being adapted to pass through one of said holes in said support bar, said adjustable drive pin carrier having a drive pin mounted on a second base of said base plate near an edge of said base plate opposite a point where said mounting bolt is affixed, to achieve a greatest possible span adjustment.

2. A spanner wrench according to claim 1 wherein said handle further comprises a transverse member attached to a second end of said handle for ease of turning said spanner wrench by an operator.

3. A spanner wrench according to claim 1 where said first and second holes in said support bar are in the same direction as the axis of rotation of an article to be turned.

4. A spanner wrench according to claim 1 wherein said support bar is constructed in a semi-circular configuration to allow said spanner wrench to be used for turning articles mounted on or around circular shafts.

* * * * *